US005476405A

United States Patent [19]

Clayborne

[11] Patent Number: 5,476,405

[45] Date of Patent: Dec. 19, 1995

[54] FINGER TIP PILLOW-TYPE SWIRL TOY

[76] Inventor: Scott D. Clayborne, 391 Dundee Rd., Glencoe, Ill. 60022

[21] Appl. No.: 438,071

[22] Filed: May 8, 1995

[51] Int. Cl.[6] ..... A63H 1/00; A63H 27/00

[52] U.S. Cl. ..... 446/236; 446/46

[58] Field of Search ..... 446/236, 46–48, 446/266, 240; 273/424, 425, 429, 412, 317

[56] References Cited

U.S. PATENT DOCUMENTS 3,026,110 3/1962 Hess et al. ..... 273/424 X 4,253,672 3/1981 Milzoff et al. ..... 273/424

4,356,660 11/1982 O'Brien ..... 446/46 X 5,067,923 11/1991 de Bourbon ..... 446/236

*Primary Examiner*—Mickey Yu

*Attorney, Agent, or Firm*—Emrich & Dithmar

[57] ABSTRACT

A soft spinning game disc with two generally circular fabric sheets connected at their peripheries by a circular cord. A central flexible cord interior to said peripheral cord defining a central area of reduced thickness and an annular area between the cords. Batting material is positioned intermediate the cords in the annular area therebetween, and a plurality of weights are circumferentially distributed in the annular area.

11 Claims, 2 Drawing Sheets

FINGER TIP PILLOW-TYPE SWIRL TOY

BACKGROUND OF THE INVENTION

This invention relates to a soft spinning or twirling disc adapted to be used by beginners or experts, children or adults, in order to provide a game for purposes of relaxation.

There are a variety of soft and hard flying game discs published in the patent literature as well as available commercially. Representative of the published literature are U.S. Pat. No. 4,223,473, issued to Brown Sep. 23, 1980 and U.S. Pat. No. 4,253,672 issued to Milzoff et al. Mar. 3, 1981. Moreover, U.S. Pat. No. 4,356,660 issued to O'Brien Nov. 2, 1982 discloses a twirling disc having a hard upper surface and a soft indentation to accommodate one or more digits of the twirler.

However, none of the prior art discussed above or disclosed in the Information Disclosure Statement accompanying this application combine the advantages of the present invention which includes a soft device having batting positioned between flexible or pliable sheets of material providing a substantial thickness to a soft spinning game or disc. Additional strengthening members at the periphery and internally of the disc provide a construction which has great advantages.

SUMMARY OF THE INVENTION

A principal object of the invention is to provide a spinning disc which allows easier performance and at the same time is soft enough so that damage to household items or to small children is precluded while having sufficient internal strength to provide the disc enough rigidity to enhance the spinning characteristics of the device.

Another object of the invention is to provide a spinning disc or game which is easily decorated in various forms to provide a device which is readily salable but also may be useful as a premium fox large companies as reduced cost sales tools or giveaways.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
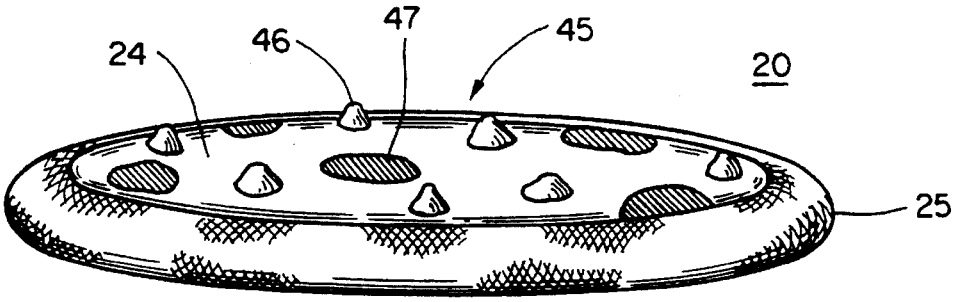
FIG. 1 is an isometric view of the spinning toy of the present invention.
Figure 2:
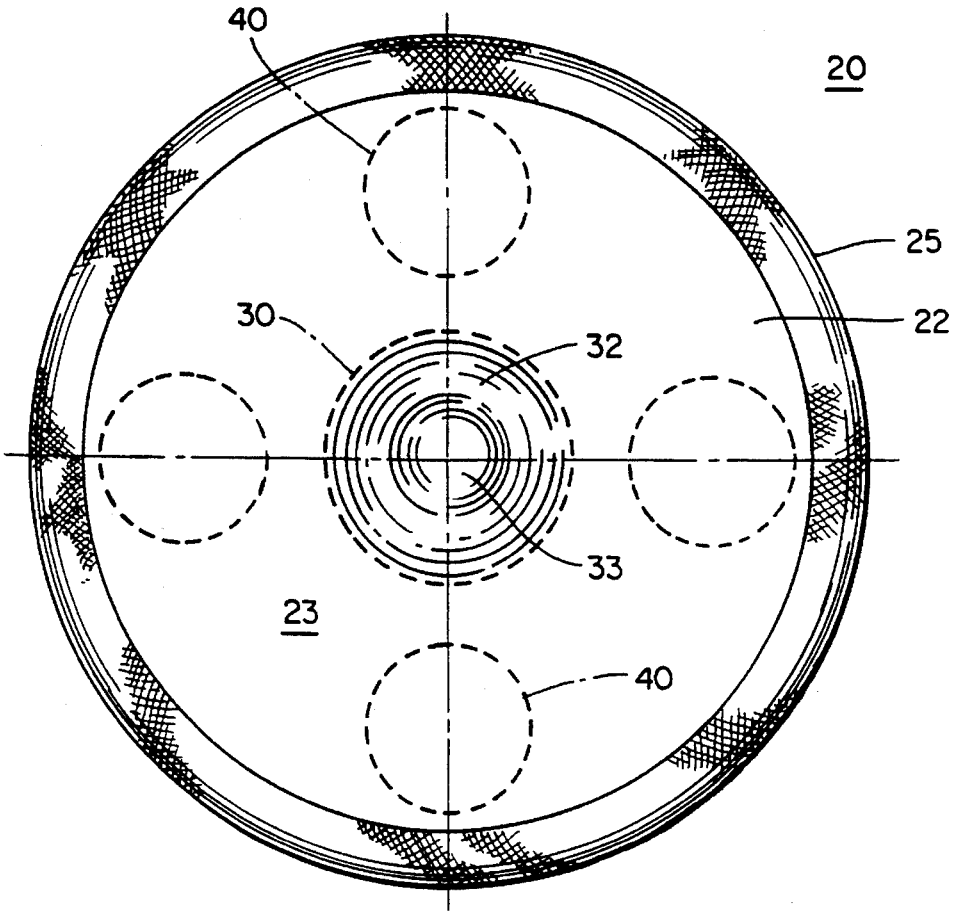
FIG. 2 is a bottom plan view of the spinning toy of the device illustrated in FIG. 1.

Referring now to the drawings, there is disclosed a disc 20 which includes an upper sheet 21 and a lower sheet 22 connected at the peripheries by a peripheral cord 25. The lower sheet 22 has a lower exposed surface 23 and the upper sheet 21 has a upper exposed surface 24. The peripheral cord 25 has a flat inner surface 26 to which are joined on the peripheral edges of the upper and lower sheets 21 and 22, respectively, and an arcuate outer surface 27, all as illustrated.

Figure 3:
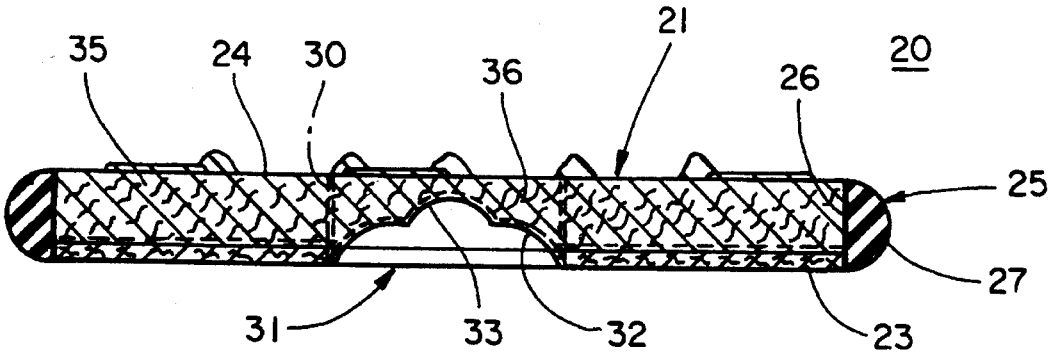
FIG. 3 is a view in vertical cross-section of the device illustrated in FIG. 1.

A circular inner cord 30 defines an inner circular area of reduced thickness 31 which is divided into a larger dome 32 and a smaller dome 33, see FIG. 3. Batting material such as polyester or other suitable material is provided in the disc 20. Batting 35 in the area between the cord 30 and the cord 25 provides an area of thicker batting and batting 36 is interior of the circular inner cord 30 providing an area of reduced thickness.

A plurality of weights 40 are preferably securely positioned and circumferentially spaced in the annular area between the inner cord 30 and the outer peripheral cord 25. More preferably, these are four such weights 40 each circular in plan view and each located 90° circumferentially from each other.

The top surface 24 of the upper sheet 21 is provided with a decorative motif. In FIGS. 1 and 3, there is illustrated a decorative motif 45 in the shape of a simulated pizza involving simulated mushrooms 46 and simulated pepperoni 47. It should be understood that the decorations 45 could be in the form of a cartoon character or of a logo of a large chain for premium purposes.

Figure 4:
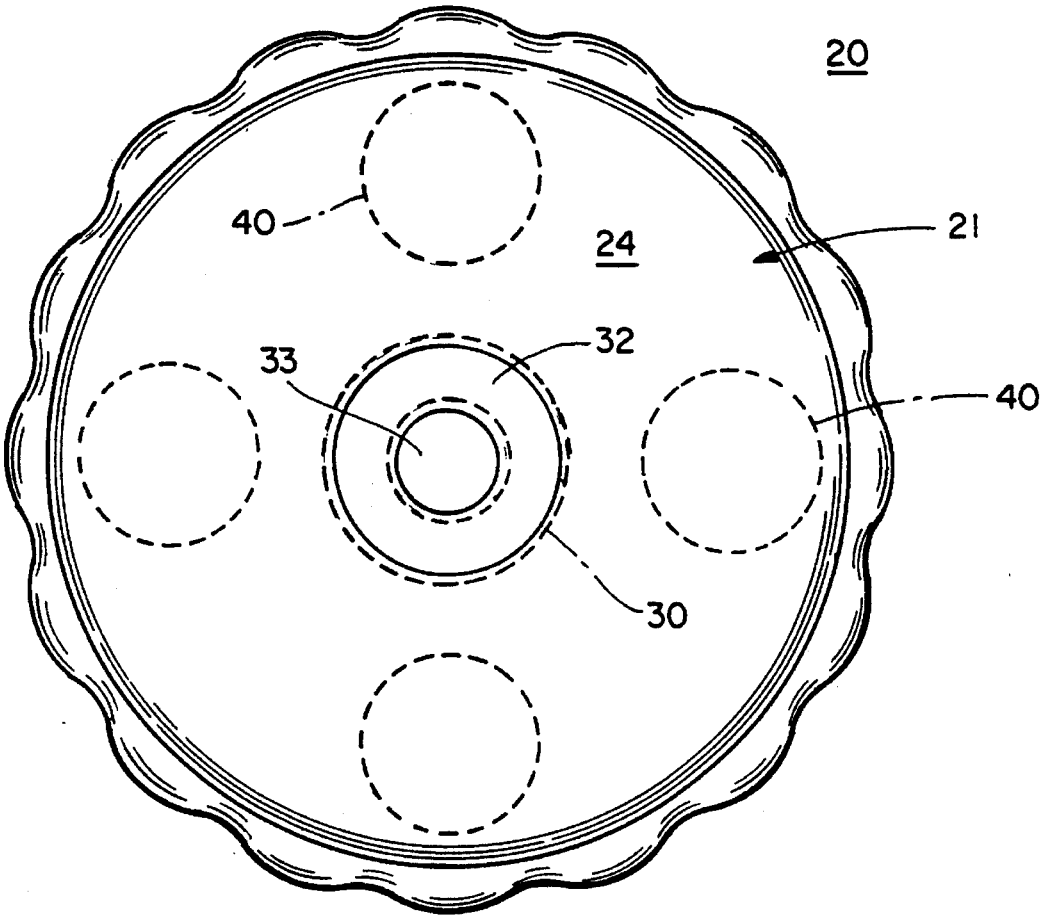
FIG. 4 is a top plan of the device illustrated in FIG. 1.

As illustrated in FIG. 4. the outer peripheral cord 25 may be fluted or scalloped in nature so as to simulate a pizza pie representation but it is not necessary to the functioning of the invention.

In operation, one or two fingers are inserted within the area 31 of seduced thickness and the toy is swung with a rotary motion of the fingers producing a circular movement as is well known and common. Because the entire toy 20 is flexible and soft, yet with a certain thickness provided by the batting 35 and 36, rotation of the toy 20 is easy and yet no substantial harm is encountered if the toy files off the fingers of a novelist user. Although the peripheral cord 25 and the internal cord 30 have some rigidity or hardness, it is insufficient to cause any significant damage to either small children or to property.

On the other hand, the rigidity provided by the peripheral cord 25 and the internal cord 30 is sufficient to provide form to the toy or disc 20 which enables spinning to be accomplished more easily than would otherwise be possible. Double dome 32 and 33 provides fox easier spinning and enables the user to keep the toy centered on the spinning digits more easily.

Preferably, the sheets 21 and 22 may be made from any suitable material. The material may be cotton or a synthetic such as a non-woven material such as Tyvex®. The peripheral cord 25 and the internal cord 30 may be made of any suitable synthetic organic resin which provides the desired stability and strength. Various PVC's, polypropylene, polyethylene or nylon may be used. The weights 40, preferably are of some plastic and may have metal inserts to provide additional weight as necessary. More specifically, the weights 40 have at least a resilient outer covering so that there are no hard edges which could injure a child if the disc 20 were to fly off the fingers and impact the child in a sensitive area of the body.

Various changes in the details may be made without departing from the spirit, or sacrificing any of the advantages of the present invention.

I claim:

1. A soft spinning game disc, said disc comprising two generally circular fabric sheets connected at their peripheries by a circular cord, a central flexible cord interior to said peripheral cord defining a central area of reduced thickness and an annular area between said cords, batting material intermediate said cords in said annular area therebetween, and a plurality of weights circumferentially distributed in said annular area.

2. The soft spinning game disc of claim 1, wherein said fabric is cloth.

3. The soft spinning game disc of claim 1, wherein said fabric is a non-woven synthetic organic resin.

4. The soft spinning game disc of claim 1, wherein said peripheral cord is hemispherical in transverse cross section.

5. The soft spinning game disc of claim 1, wherein said central cord is circular.

6. The soft spinning game disc of claim 1, wherein said central cord interconnects said fabric sheets.

7. The soft spinning game disc of claim 1 and further comprising batting material between said fabric sheets in said central area, the thickness of said batting in said central area being less than the thickness of said batting in said annular space.

8. The soft spinning game disc of claim 1, wherein these are four weights.

9. The soft spinning game disc of claim 8, wherein said weights are spaced 90° circumferentially from each other.

10. The soft spinning game disc of claim 9 and further comprising decorative material on an outer surface of one of said fabric sheets.

11. The soft spinning game disc of claim 10 wherein the decorative material simulates a pizza.

* * * * *